US006761593B2

(12) United States Patent
Hu

(10) Patent No.: US 6,761,593 B2
(45) Date of Patent: Jul. 13, 2004

(54) ELECTRICAL SOCKET WITH A PROTRUSION AND A SPRING TERMINAL PIECE FOR CLAMPING A PLUG THEREBETWEEN

(75) Inventor: Chien-Ming Hu, Tainan Hsien (TW)

(73) Assignee: Excell Cell Electronic Co. Ltd., Taichung (TW)

( * ) Notice: Subject to any disclaimer, the term of this patent is extended or adjusted under 35 U.S.C. 154(b) by 0 days.

(21) Appl. No.: 10/267,878

(22) Filed: Oct. 10, 2002

(65) Prior Publication Data

US 2004/0038573 A1 Feb. 26, 2004

(51) Int. Cl.[7] ..... H01R 24/04
(52) U.S. Cl. ..... 439/668; 439/669; 439/346
(58) Field of Search ..... 439/668, 669, 439/346, 592, 675, 947, 570

(56) References Cited

U.S. PATENT DOCUMENTS 4,619,496 A * 10/1986 Forney et al. ..... 439/434
4,934,367 A * 6/1990 Daglow et al. ..... 439/527
4,954,096 A * 9/1990 Frank ..... 439/346
5,147,221 A * 9/1992 Cull et al. ..... 439/585
5,961,347 A * 10/1999 Hsu ..... 439/570
6,478,617 B2 * 11/2002 Fan ..... 439/570

FOREIGN PATENT DOCUMENTS

GB 0945482 * 1/1964

* cited by examiner

*Primary Examiner*—Hae Moon Hyeon
(74) *Attorney, Agent, or Firm*—Baker Botts L.L.P.

(57) ABSTRACT

An electrical socket includes a socket body, a central terminal pin, and a curved spring terminal piece. The socket body includes a bottom surface with a dovetail groove, which has a rear end retaining portion that is adapted to receive an engaging end portion of a hollow plug fittingly therein, and a protrusion adapted to engage an annular groove in the plug. The central terminal pin is adapted to be inserted into the plug for electrical connection therewith. The spring terminal piece has a movable portion that is adapted to engage the groove in the plug so as to press the plug against the protrusion such that the plug is clamped between the protrusion and the terminal pin, thereby forming electrical connection with the plug when the plug is inserted into the socket body.

5 Claims, 7 Drawing Sheets

ELECTRICAL SOCKET WITH A PROTRUSION AND A SPRING TERMINAL PIECE FOR CLAMPING A PLUG THEREBETWEEN

BACKGROUND OF THE INVENTION

1. Field of the Invention

The invention relates to an electrical socket, more particularly to an electrical socket that is used for recharging electronic equipment.

2. Description of the Related Art

Referring to FIGS. 1 to 3, a conventional electrical socket 1 is adapted to be mounted on a circuit board (not shown), and is used for receiving a hollow plug 2 of an electronic equipment that is to be recharged. The plug 2 includes an engaging end portion 20 having an outer surface formed with an annular groove 21. The conventional electrical socket 1 includes a socket body 11, a central terminal pin 12 fixed within the socket body 11, a first terminal 13 connected fixedly to a lateral side of the socket body 11 and connected electrically to the central terminal pin 12, a second terminal 14 inserted into the socket body 11, and a spring terminal piece 15 adjacent to the second terminal 14.

The socket body 11 includes a wall unit 111 that defines a plug hole 112 for receiving the plug 2 of the electronic equipment therein, and a receiving recess portion 113 that is in communication with the plug hole 112. The plug hole 112 has a diameter, which is much larger than that of the engaging end portion 20 of the plug 2, and has an open end 1121 and a closed end 1122 opposite to the open end 1121. The first and second terminals 13, 14 are isolated electrically from each other. The spring terminal piece 15 includes a positioning portion 151 positioned on the socket body 11, a limiting portion 152 abutting releasably against the second terminal 14, and a curved movable portion 153 interconnecting the positioning and limiting portions 151, 152 and extending into the plug hole 112.

Before the plug 2 of the electronic equipment is inserted into the plug hole 112 in the socket 1, the limiting portion 152 of the spring terminal piece 15 is in electrical contact with the second terminal 14. In actual practice, the spring terminal piece 15 and the second terminal 14 are connected electrically to a light source (not shown), such as a light emitting diode, so that on/off operation of the light source is controlled by electrical connection and disconnection of the spring terminal piece 15 and the second terminal 14.

Referring to FIG. 3, when the plug 2 is inserted into the plug hole 112, it is sleeved directly on the central terminal pin 12 so as to connect electrically with the first terminal 13, thereby permitting recharging of the electronic equipment. The movable portion 153 of the spring terminal piece 15 is pressed downwardly by the plug 2 at this moment so as to move the limiting portion 152 of the spring terminal piece 15 away from the second terminal 14 so that the light source is turned off. When the engaging end portion 20 of the plug 2 is disposed at the closed end 1122 of the plug hole 112, the movable portion 153 of the spring terminal piece 15 engages the groove 21 in the engaging end portion 20 of the plug 2, thereby preventing removal of the plug 2 from the central terminal pin 12. At this moment, the electronic equipment can be recharged.

However, in actual practice, the spring terminal piece 15 of the conventional electrical socket 1 easily experiences fatigue due to frequent plugging and removal of the plug 2 with respect to the electrical socket 1, such that the plug 2 is likely to loosen undesirably from the electrical socket 1. Furthermore, the service life of the conventional electrical socket 1 is shortened.

SUMMARY OF THE INVENTION

Therefore, the main object of the present invention is to provide an electrical socket that is capable of overcoming the aforementioned drawbacks of the prior art.

According to the present invention, an electrical socket is adapted for receiving a hollow plug of an electronic equipment therein so as to permit recharging of the electronic equipment. The plug includes an engaging end portion that has an outer surface formed with an annular groove. The socket comprises a socket body made of an insulating material, a central terminal pin, and a curved spring terminal piece. The socket body includes a front surface, a bottom surface, and a protrusion. The bottom surface has a dovetail groove, which is adapted to receive the hollow plug therein and which has an open end that is formed in the front surface of the socket body, and a closed end opposite to the open end of the dovetail groove. The dovetail groove is defined by an inner wall surface, and has a rear end retaining portion that is proximate to the closed end of the dovetail groove and that is adapted to receive the engaging end portion of the plug fittingly therein. The protrusion protrudes from the inner wall surface, and is adapted to engage the annular groove in the plug when the plug is inserted into the socket body. The central terminal pin is fixed within the socket body, extends along the center of the dovetail groove, and is adapted to be inserted into the plug so as connect electrically therewith, thereby permitting recharging of the electronic equipment. The curved spring terminal piece is disposed in the socket body, and has an end fastened to the socket body, and a movable portion that is adapted to engage the groove in the plug so as to be adapted to press the plug against the protrusion such that the plug is clamped between the protrusion and the terminal pin.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
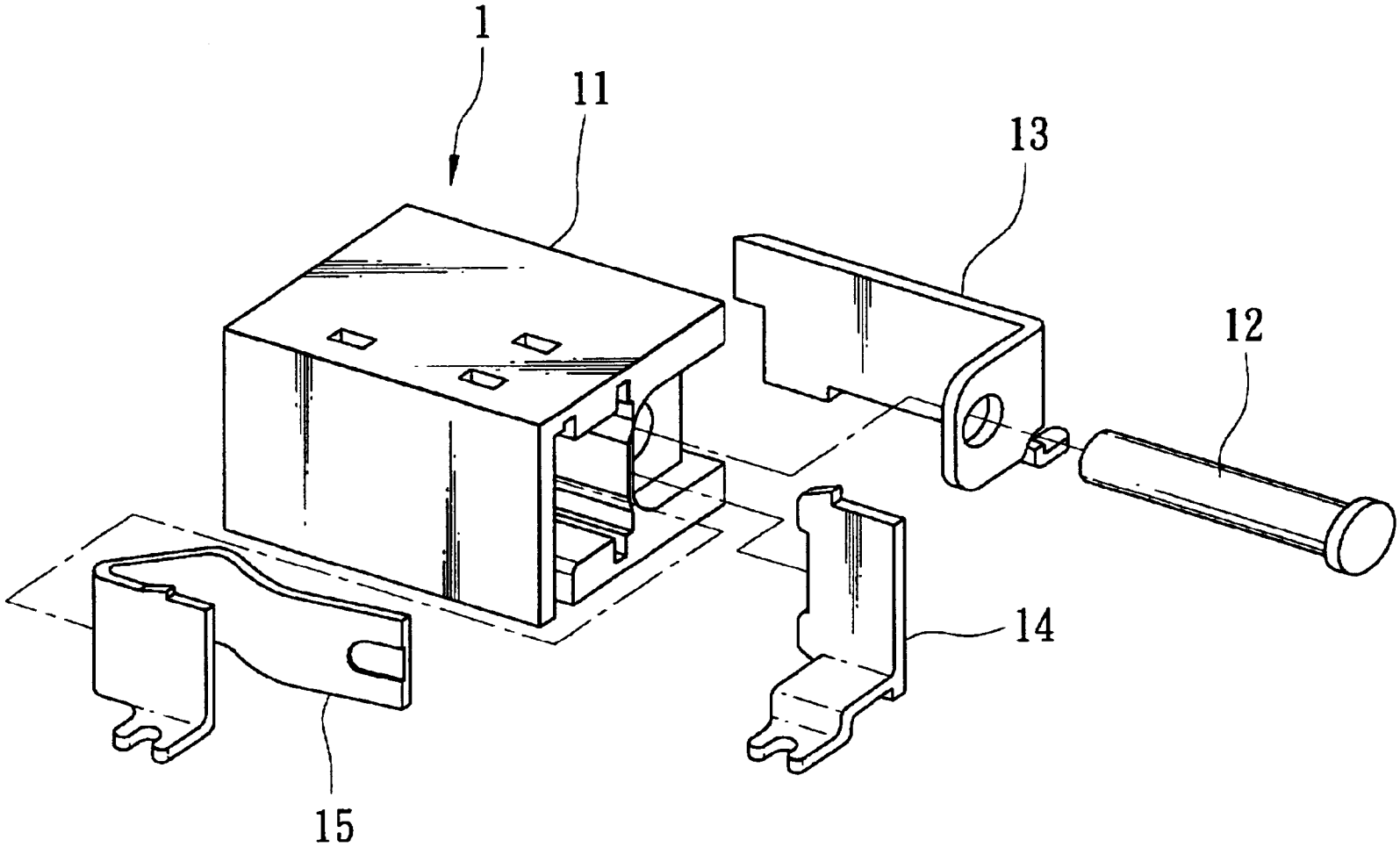
FIG. 1 PRIOR ART
FIG. 1 is an exploded perspective view of a conventional electrical socket.

Referring to FIGS. 4 to 7, the preferred embodiment of an electrical socket 3 according to the present invention is adapted to be mounted on a circuit board (not shown), and is shown to be adapted for receiving a hollow plug 4 of an electronic equipment therein so as to permit recharging of the electronic equipment (not shown). The plug 4 includes an engaging end portion 40 that has an outer surface formed with an annular groove 41. The socket 3 comprises a socket body 31, a central terminal pin 32, a first terminal 33, a second terminal 34, a curved spring terminal piece 35, and two support seats 36.

Figure 5:
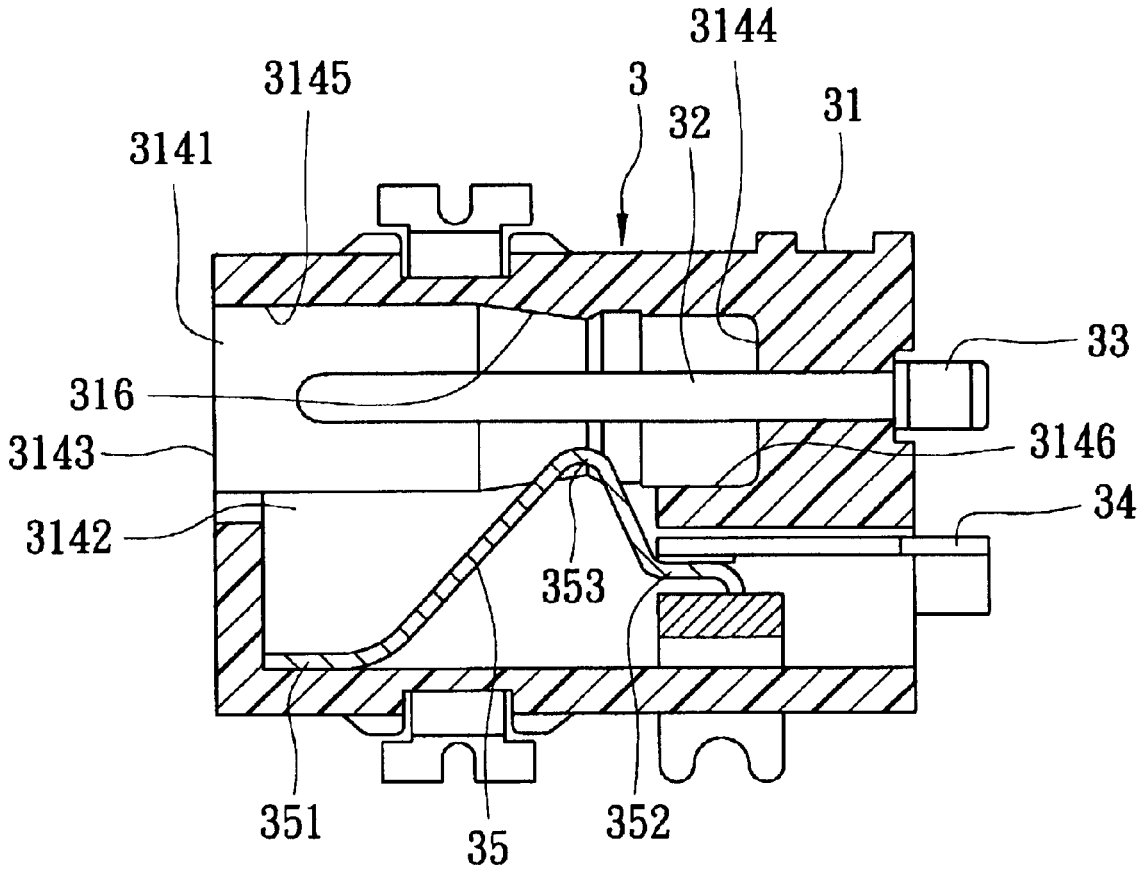
FIG. 5 is a sectional view of the preferred embodiment.

The socket body 31 is made of an insulating material, and includes a front surface 313, a bottom surface 314, two opposite side walls 315, and a protrusion 316 (see FIG. 5). The bottom surface 314 has a dovetail groove 3141, which is adapted to receive the hollow plug 4 therein and which has an open end 3143 that is formed in the front surface 313 of the socket body 31, and a closed end 3144 (see FIG. 5) opposite to the open end 3143 of the dovetail groove 3141. The dovetail groove 3141 is defined by an inner wall surface 3145, and has a rear end retaining portion 3146 that is proximate to the closed end 3144 of the dovetail groove 3141 and that is adapted to receive the engaging end portion 40 of the plug 4 fittingly therein. The socket body 31 further includes a receiving space 3142 that is in communication with the dovetail groove 3141.

Each of the side walls 315 of the socket body 31 has a bottom side 3151 (see FIG. 7), and is formed with a positioning slot 3152 (see FIG. 7), which has open upper and lower ends 3152*a*, 3152*b*. The protrusion 316 (see FIG. 5) protrudes from the inner wall surface 3145, and is adapted to engage the annular groove 41 in the plug 4 when the plug 4 is inserted into the socket body 31.

The central terminal pin 32 is fixed within the socket body 31, extends along the center of the dovetail groove 3141, and is adapted to be inserted into the plug 4 so as to connect electrically therewith, thereby permitting recharging of the electronic equipment.

The first terminal 33 is disposed on the socket body 31, and is electrically connected to the central terminal pin 32.

The second terminal 34 is disposed in the receiving space 3142 in the socket body 31.

The curved spring terminal piece 35 is disposed in the receiving space 3142 in the socket body 31, and has an end 351 fastened to the socket body 31, a limiting portion 352 abutting releasably against the second terminal 34, and a movable portion 353 that interconnects the end 351 and the limiting portion 352, and that extends into the dovetail groove 3141 so as to be adapted to engage releasably the groove 41 in the plug 4 and so as to be adapted to press the plug 4 against the protrusion 316 such that the plug 4 is clamped between the protrusion 316 and the terminal pin 32 and such that an electrical connection is formed between the spring terminal piece 35 and the first terminal 31 when the plug 4 is inserted into the socket body 31, thereby recharging the electronic equipment.

Each of the support seats 36 (see FIGS. 4 and 7) includes a positioning plate portion 361 and a support plate portion 362. Each of the positioning plate portions 361 abuts against and is attached fixedly to a respective one of the side walls 315 of the socket body 31, and has a bottom side 3611 (see FIG. 7) that extends along the bottom side 3151 of the respective one of the side walls 315 of the socket body 31. Each of the support plate portions 362 extends integrally, perpendicularly, and outwardly from the bottom side 3611 of a respective one of the positioning plate portions 361, and is adapted to be soldered to the circuit board (not shown). Each of the positioning plate portions 361 of the support seats 36 is received in a respective one of the positioning slots 3152 in the side walls 315 of the socket body 31 fittingly therein. Each of the support plate portions 362 of the support seats 36 has a bifurcated outer end 3621 (see FIG. 7), which is distal to the bottom side 3611 of a respective one of the positioning plate portions 361 and which is formed with two integral extensions 3622 that extend away from each other in a direction parallel to the bottom sides 3611 of the positioning plate portions 361 of the support seats 36.

Figure 2:
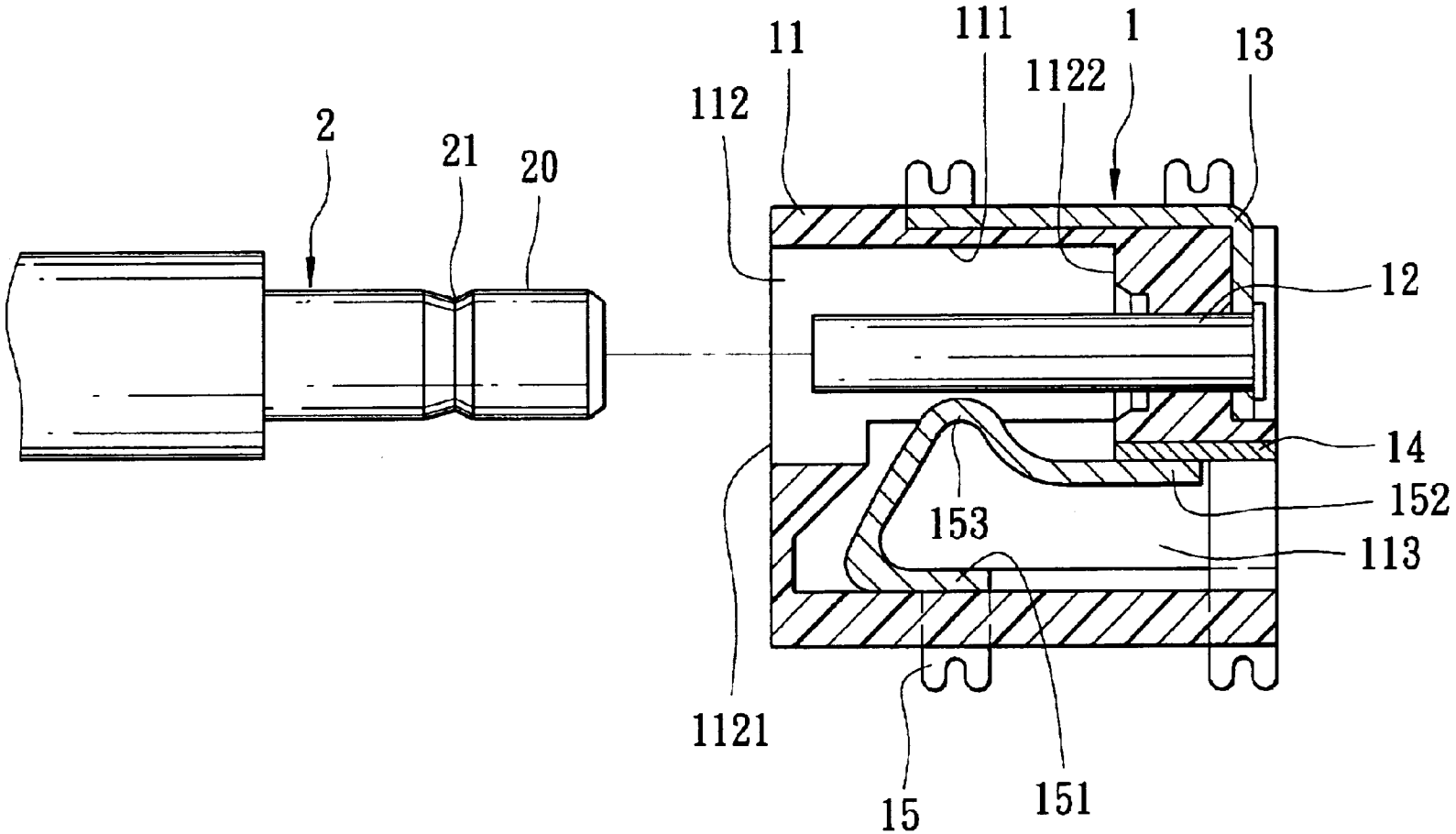
FIG. 2 PRIOR ART
FIG. 2 is a sectional view of the conventional electrical socket in an assembled state, illustrating how a plug is inserted into the socket.
Figure 3:
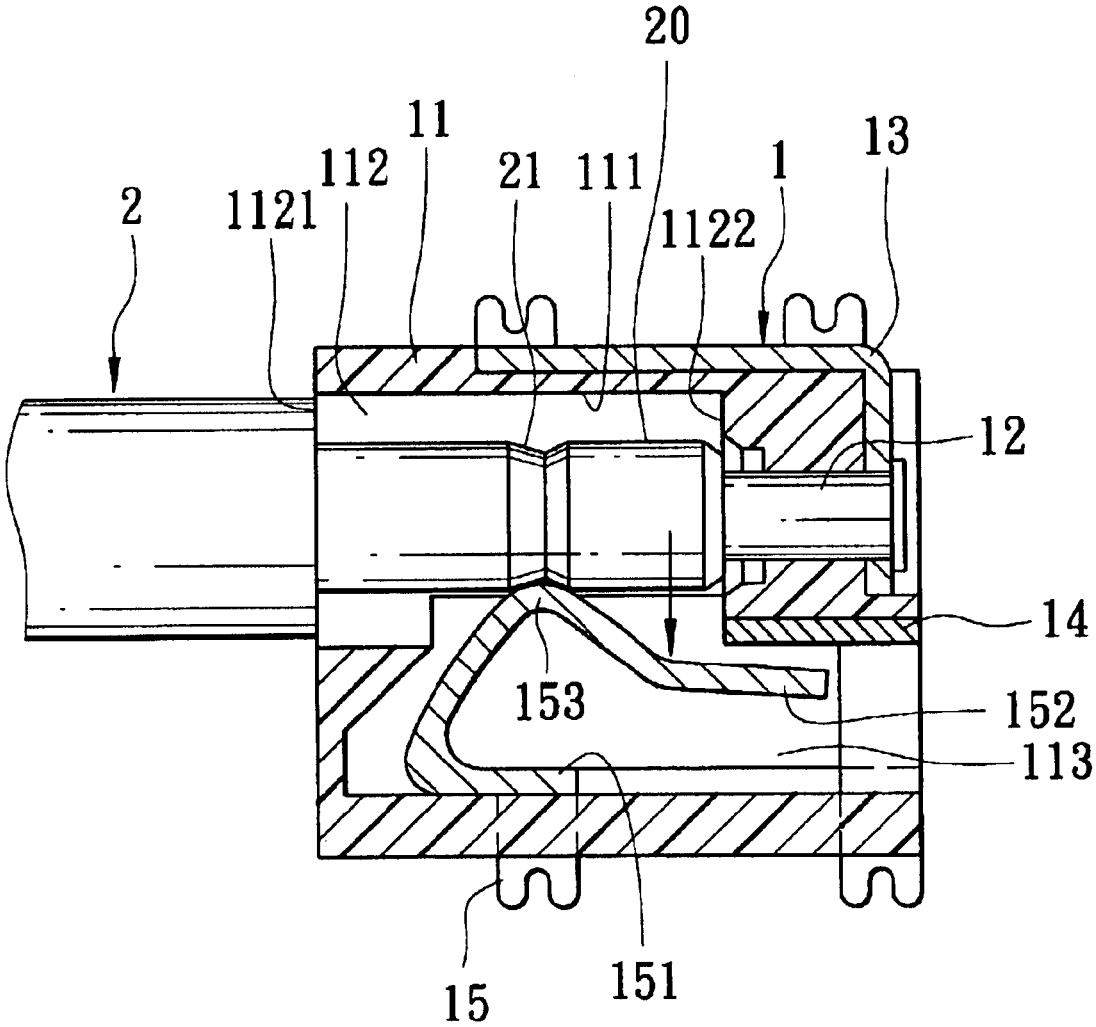
FIG. 3 PRIOR ART
FIG. 3 is a sectional view of the conventional electrical socket in a state of use.
Figure 4:
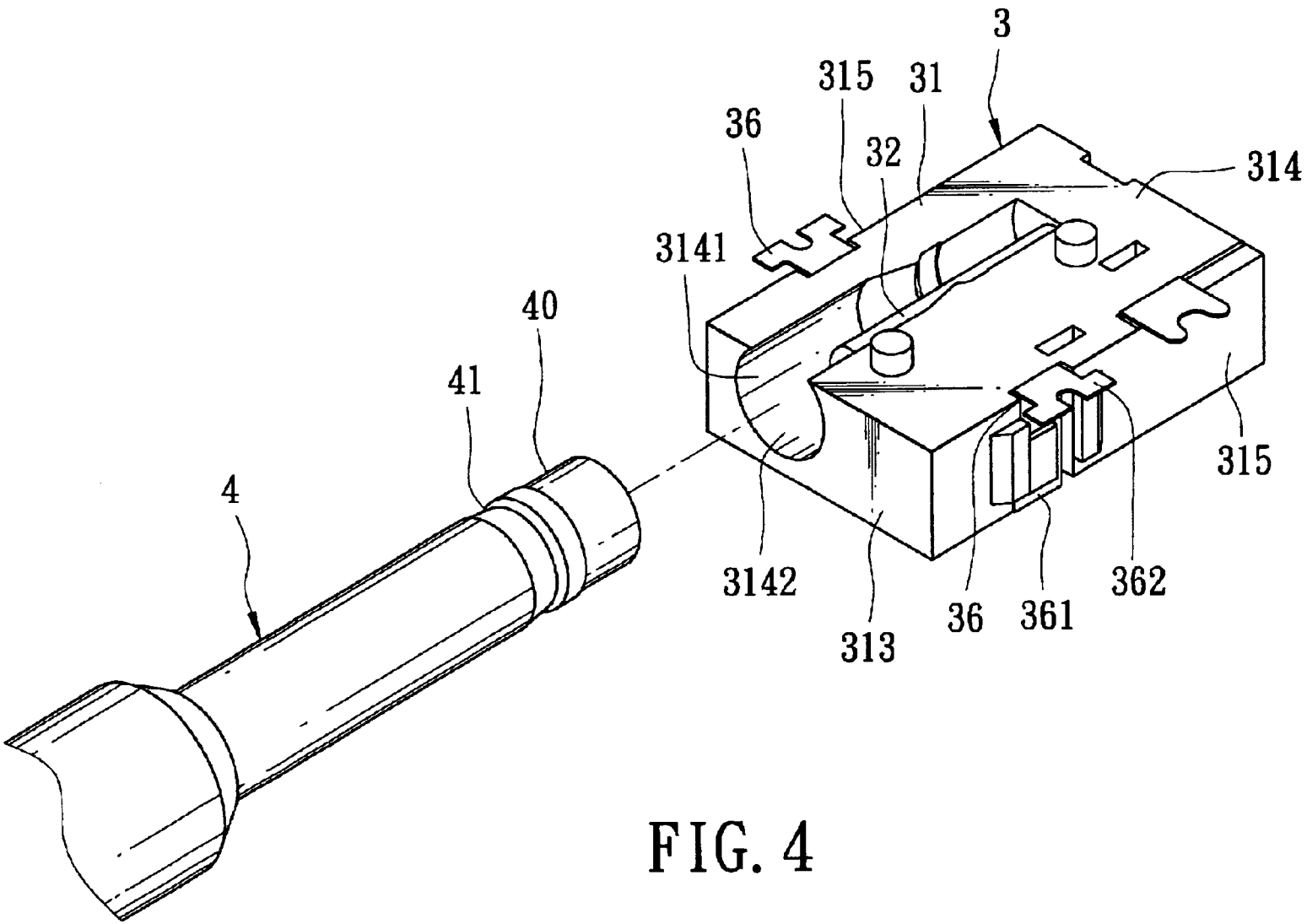
FIG. 4 is a perspective view of the preferred embodiment of an electrical socket according to the present invention in an inverted state, illustrating how a plug is inserted into the socket.

Use of the preferred embodiment is substantially similar to the conventional electrical socket 1 (see FIGS. 1 to 3). Particularly, before the plug 4 of the electronic equipment is inserted into the dovetail groove 3141 in the socket body 31, the limiting portion 352 of the spring terminal piece 35 is in electrical contact with the second terminal 34. The spring terminal piece 35 and the second terminal 34 are connected electrically to a light source (not shown), such as a light emitting diode, so that on/off operation of the light source is controlled by electrical connection and disconnection of the spring terminal piece 35 and the second terminal 34.

Figure 6:
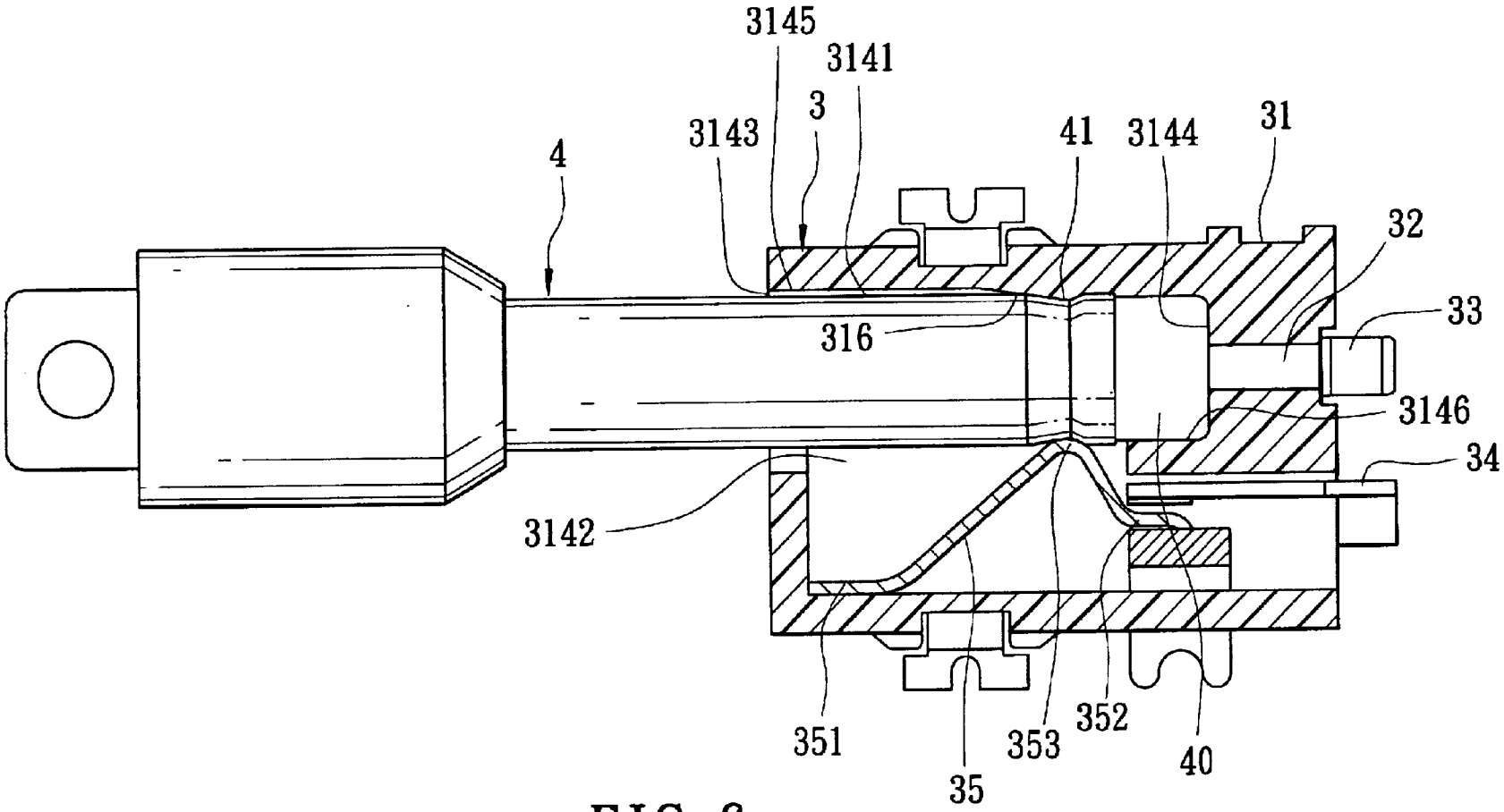
FIG. 6 is a sectional view of the preferred embodiment in a state of use.
Figure 7:
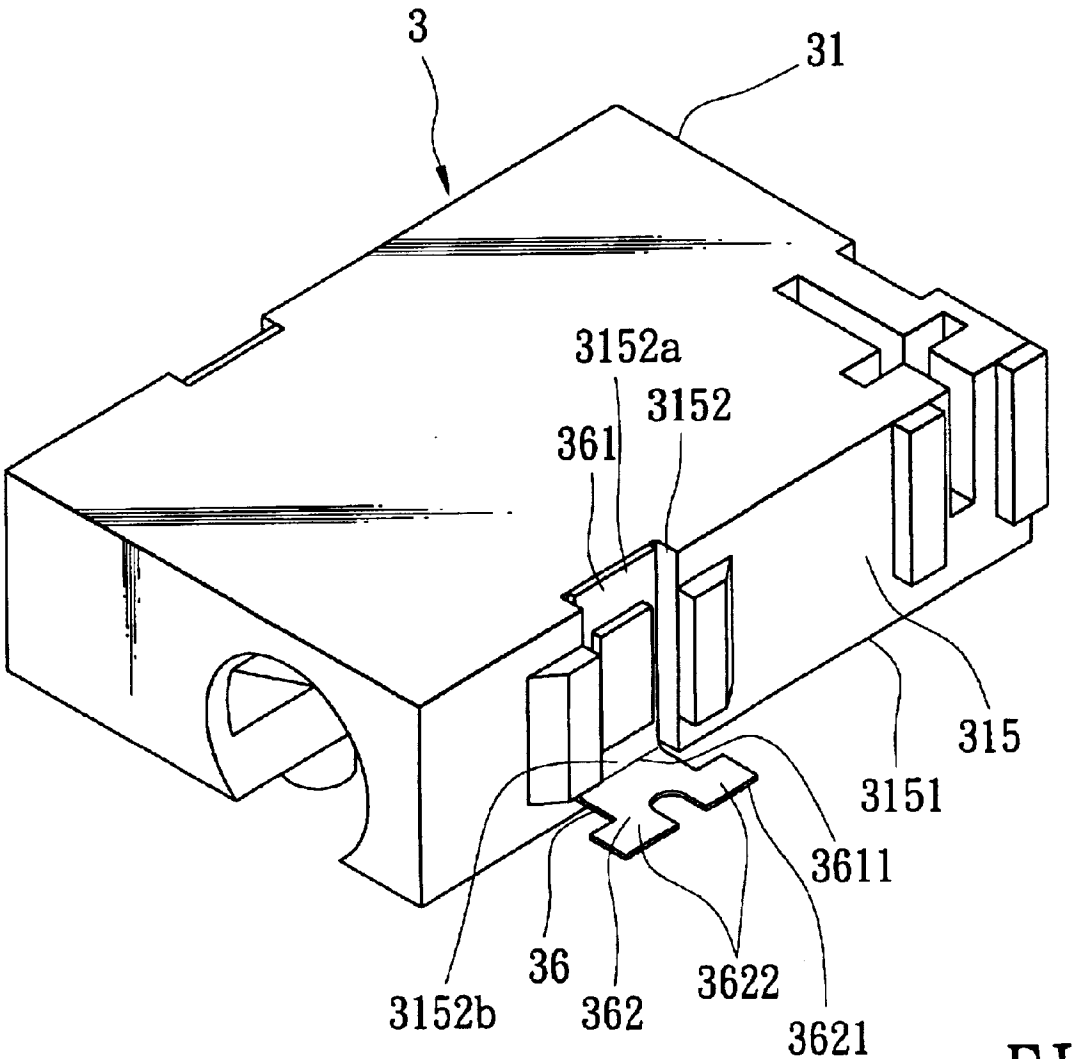
FIG. 7 is a perspective view of the preferred embodiment.

Referring to FIG. 6, when the plug 4 is inserted into the dovetail groove 3141, the movable portion 353 of the spring terminal piece 15 is pressed downwardly by the plug 4 so as to move the limiting portion 352 of the spring terminal piece 35 away from the second terminal 34 so that the light source is turned off. When the engaging end portion 40 of the plug 4 reaches the closed end 3144 of the dovetail groove 3141, the annular groove 41 in the engaging end portion 40 of the plug 4 engages the protrusion 316 and the movable portion 353 of the spring terminal piece 35, such that the plug 4 is clamped firmly between the protrusion 316 and the movable portion 353 of the spring terminal piece 35. At this moment, the engaging end portion 40 of the plug 4 is retained in the rear end retaining portion 3146 of the dovetail groove 3141, and the spring terminal piece 35 is connected electrically to the first terminal 33. Recharging of the electronic equipment can proceed at this time.

From the above-mentioned description of the preferred embodiment, it can be seen that the biasing force of the spring terminal piece 35 needed to be applied on the plug 4 is reduced due to the presence of the protrusion 316 and the rear end retaining portion 3146 of the dovetail groove 3141, thereby prolonging the service life of the electrical socket 3. Furthermore, the socket 3 of the present invention can be soldered more firmly on the circuit board due to the configuration of the support seats 36.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An electrical socket adapted for receiving a hollow plug of an electronic equipment therein so as to permit recharging of the electronic equipment, the plug including an engaging end portion that has an outer surface formed with an annular groove, said socket comprising:

a socket body made of an insulating material and including a front surface, a bottom surface having a dovetail groove, which is adapted to receive the hollow plug therein and which has an open end that is formed in said front surface of said socket body, and a closed end opposite to said open end of said dovetail groove, said dovetail groove being defined by an inner wall surface and having a rear end retaining portion that is proximate to said closed end of said dovetail groove and that is adapted to receive the engaging end portion of the plug fittingly therein, and a protrusion protruding from said inner wall surface and adapted to engage the annular groove in the plug when the plug is inserted into said socket body;

a central terminal pin fixed within said socket body and extending along the center of said dovetail groove, said terminal pin being adapted to be inserted into the plug so as to connect electrically therewith, thereby permitting recharging of the electronic equipment; and a curved spring terminal piece disposed in said socket body and having an end fastened to said socket body and a movable portion that is adapted to engage the groove in the plug so as to be adapted to press the plug against said protrusion such that the plug is clamped between said protrusion and said terminal pin; said protrusion and said movable portion disposed in opposition within said socket body and adapted to engage opposite sides of said plug.

2. The electrical socket of claim 1, wherein said socket body has two opposite side walls, each of which has a bottom side, said electrical socket further including two support seats, each of which includes:

a positioning plate portion abutting against and attached fixedly to a respective one of said side walls of said socket body, said positioning plate portion having a bottom side that extends along said bottom side of the respective one of said side walls of said socket body; and a support plate portion extending integrally, perpendicularly, and outwardly from said bottom side of said positioning plate portion and adapted to be soldered to a circuit board.

3. The electrical socket of claim 2, wherein each of said support plate portions of said support seats has a bifurcated outer end, which is distal to said bottom side of a respective one of said positioning plate portions and which is formed with two integral extensions that extend away from each other in a direction parallel to said bottom sides of said positioning plate portions of said support seats.

4. The electrical socket of claim 3, wherein each of said side walls of said socket body is formed with a positioning slot, which has two open ends and which receives a respective one said positioning plate portions of said support seats fittingly therein.

5. The electrical socket of claim 1, wherein said spring terminal piece further has a limiting portion, said electrical socket further including:

a first terminal disposed on said socket body and connected electrically to said central terminal pin; and a second terminal disposed in said socket body and isolated electrically from said first terminal, said limiting portion of said spring terminal piece being in electrical contact with said second terminal before the plug is inserted into said dovetail groove and being removed from said second terminal when the plug is inserted into said dovetail groove and when said movable portion of said spring terminal piece engages the groove in the plug.

* * * * *